US008074980B2

(12) United States Patent
Partridge et al.

(10) Patent No.: US 8,074,980 B2
(45) Date of Patent: Dec. 13, 2011

(54) APPARATUSES FOR FEEDING SHEETS AND PRINTING APPARATUSES

(75) Inventors: Colin Jon Partridge, Baldock (GB); Paul J. Newland, Market Harborough (GB)

(73) Assignee: Xerox Corporation, Norwalk, CT (US)

( * ) Notice: Subject to any disclaimer, the term of this patent is extended or adjusted under 35 U.S.C. 154(b) by 225 days.

(21) Appl. No.: 12/478,391

(22) Filed: Jun. 4, 2009

(65) Prior Publication Data

US 2010/0308529 A1 Dec. 9, 2010

(51) Int. Cl.
*B65H 3/56* (2006.01)

(52) U.S. Cl. ..... 271/169; 271/145

(58) Field of Classification Search ..... 271/169, 271/146, 220

See application file for complete search history.

(56) References Cited

U.S. PATENT DOCUMENTS 4,708,462 A * 11/1987 Stemmle ..... 355/24
5,188,353 A * 2/1993 Parks ..... 271/184
5,713,187 A * 2/1998 Peterson ..... 53/566
6,382,621 B1 * 5/2002 Inoue et al. ..... 271/120
6,409,165 B1 * 6/2002 Yamaoka et al. ..... 271/145
6,422,772 B1 * 7/2002 Fisher et al. ..... 400/629
6,916,019 B2 * 7/2005 Takahashi ..... 271/145
2004/0251592 A1 * 12/2004 Ruhe et al. ..... 271/109
2007/0273084 A1 * 11/2007 Chu et al. ..... 271/162
2008/0037069 A1 2/2008 Mestha et al.

* cited by examiner

*Primary Examiner* — Stefanos Karmis
*Assistant Examiner* — Howard Sanders
(74) *Attorney, Agent, or Firm* — Ronald E. Prass, Jr.; Prass LLP

(57) ABSTRACT

Apparatuses for feeding sheets and printing apparatuses are provided. An exemplary embodiment of the apparatuses for feeding sheets includes a first guide; a second guide opposite the first guide; a first side wall; a second side wall opposite the first side wall; a support surface configured to support a stack of sheets with a first edge of the sheets facing the first guide, a second edge of the sheets facing the second guide and a center line of the stack extending from the first edge to the second edge; and at least two tampers including: a first tamper secured to the first guide between the center line and the first side wall, the first tamper including a first lower pad and a first upper pad which applies a lower force to the first edge of the sheets than the first lower pad; and a second tamper secured to the first guide between the center line and the second side wall, the second tamper including a second lower pad and a second upper pad which applies a lower force to the first edge of the sheets than the second lower pad.

9 Claims, 4 Drawing Sheets

APPARATUSES FOR FEEDING SHEETS AND PRINTING APPARATUSES

BACKGROUND

Printing apparatuses can include a tray to contain sheets of media used to produce prints. In such apparatuses, when stacks of the sheets are loaded into the tray, variable loading can cause the stacks' positions to vary in both position and straightness. Such variable loading can detrimentally affect the feeding of the sheets from the tray.

It would be desirable to provide apparatuses for feeding sheets and printing apparatuses constructed to assist positioning of as-loaded sheets in trays to improve feeding of the sheets.

SUMMARY

Apparatuses for feeding sheets and printing apparatuses are provided. An exemplary embodiment of the apparatuses for feeding sheets comprises a first guide; a second guide opposite the first guide; a first side wall; a second side wall opposite the first side wall; a support surface configured to support a stack of sheets with a first edge of the sheets facing the first guide, a second edge of the sheets facing the second guide and a center line of the stack extending from the first edge to the second edge; and at least two tampers including: a first tamper secured to the first guide between the center line and the first side wall, the first tamper including a first lower pad and a first upper pad which applies a lower force to the first edge of the sheets than the first lower pad; and a second tamper secured to the first guide between the center line and the second side wall, the second tamper including a second lower pad and a second upper pad which applies a lower force to the first edge of the sheets than the second lower pad.

DRAWINGS

DETAILED DESCRIPTION

The disclosed embodiments include an apparatus for feeding sheets comprising a first guide; a second guide opposite the first guide; a first side wall; a second side wall opposite the first side wall; a support surface configured to support a stack of sheets with a first edge of the sheets facing the first guide, a second edge of the sheets facing the second guide and a center line of the stack extending from the first edge to the second edge; and at least two tampers including: a first tamper secured to the first guide between the center line and the first side wall, the first tamper including a first lower pad and a first upper pad which applies a lower force to the first edge of the sheets than the first lower pad; and a second tamper secured to the first guide between the center line and the second side wall, the second tamper including a second lower pad and a second upper pad which applies a lower force to the first edge of the sheets than the second lower pad.

The disclosed embodiments further include a printing apparatus comprising at least one media tray for feeding sheets. The media tray includes a first guide; a second guide opposite the first guide; a first side wall; a second side wall opposite the first side wall; and a support surface configured to support a stack of sheets with a first edge of the sheets facing the first guide, a second edge of the sheets facing the second guide and a center line of the stack extending from the first edge to the second edge. The media tray further includes at least two tampers including: a first tamper secured to the first guide between the center line and the first side wall, the first tamper including a first lower pad and a first upper pad which applies a lower force to the first edge of the sheets than the first lower pad; and a second tamper secured to the first guide between the center line and the second side wall, the second tamper including a second lower pad and a second upper pad which applies a lower force to the first edge of the sheets than the second lower pad.

As used herein, the term "printing apparatus" encompasses apparatuses including digital copiers, bookmaking machines, multifunction machines, and the like, or portions of such apparatuses, that perform a print outputting function for any purpose. The printing apparatuses can use various types of solid and liquid marking materials, and treat the marking materials using various process conditions to form images on media.

Figure 1:
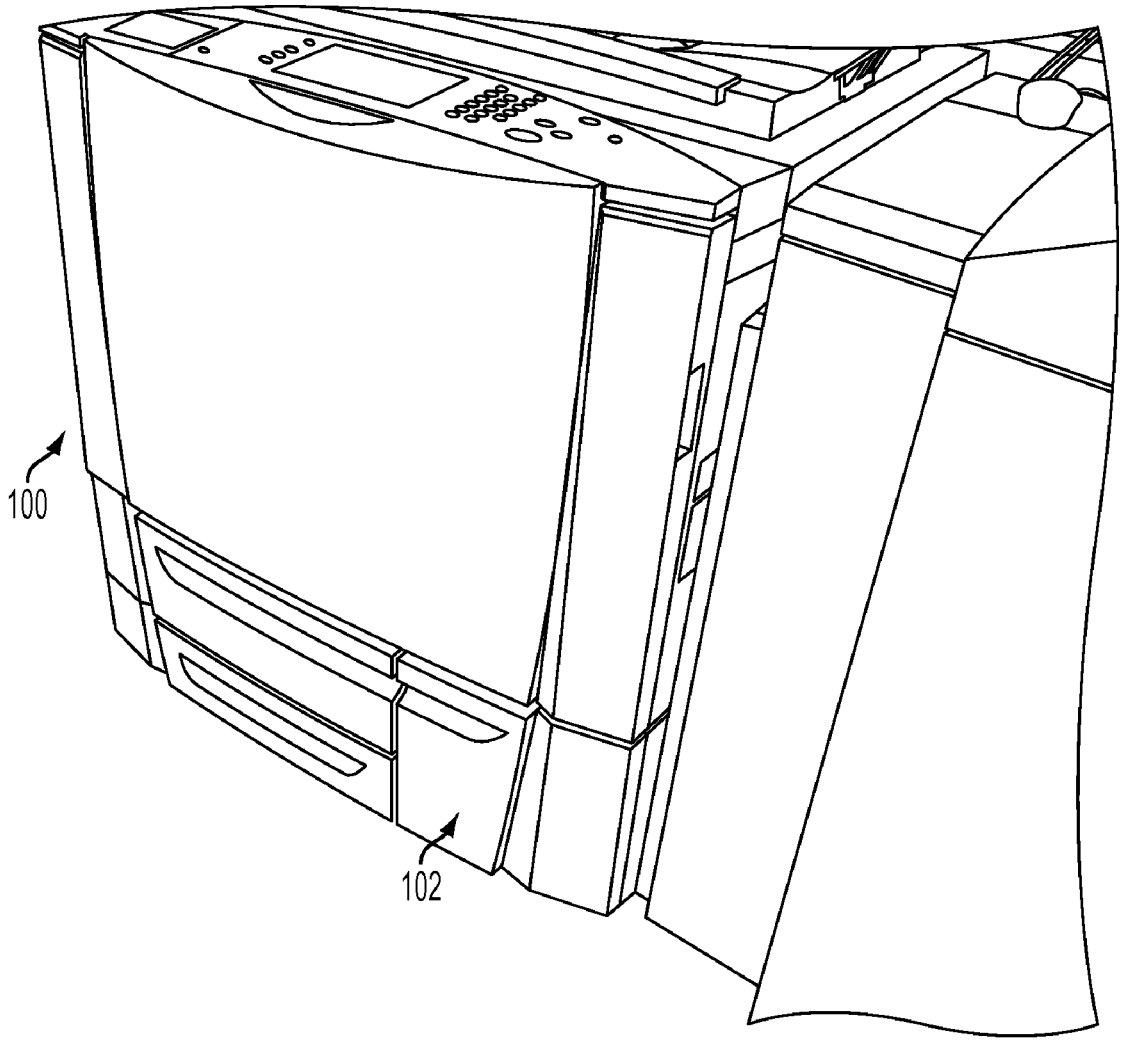
FIG. 1 depicts an exemplary embodiment of a printing apparatus.

FIG. 1 illustrates a printing apparatus 100 according to an exemplary embodiment. The printing apparatus 100 can produce prints using sheets of paper and other types of media. The printing apparatus 100 includes a drawer 102 shown in a closed position.

Figure 2:
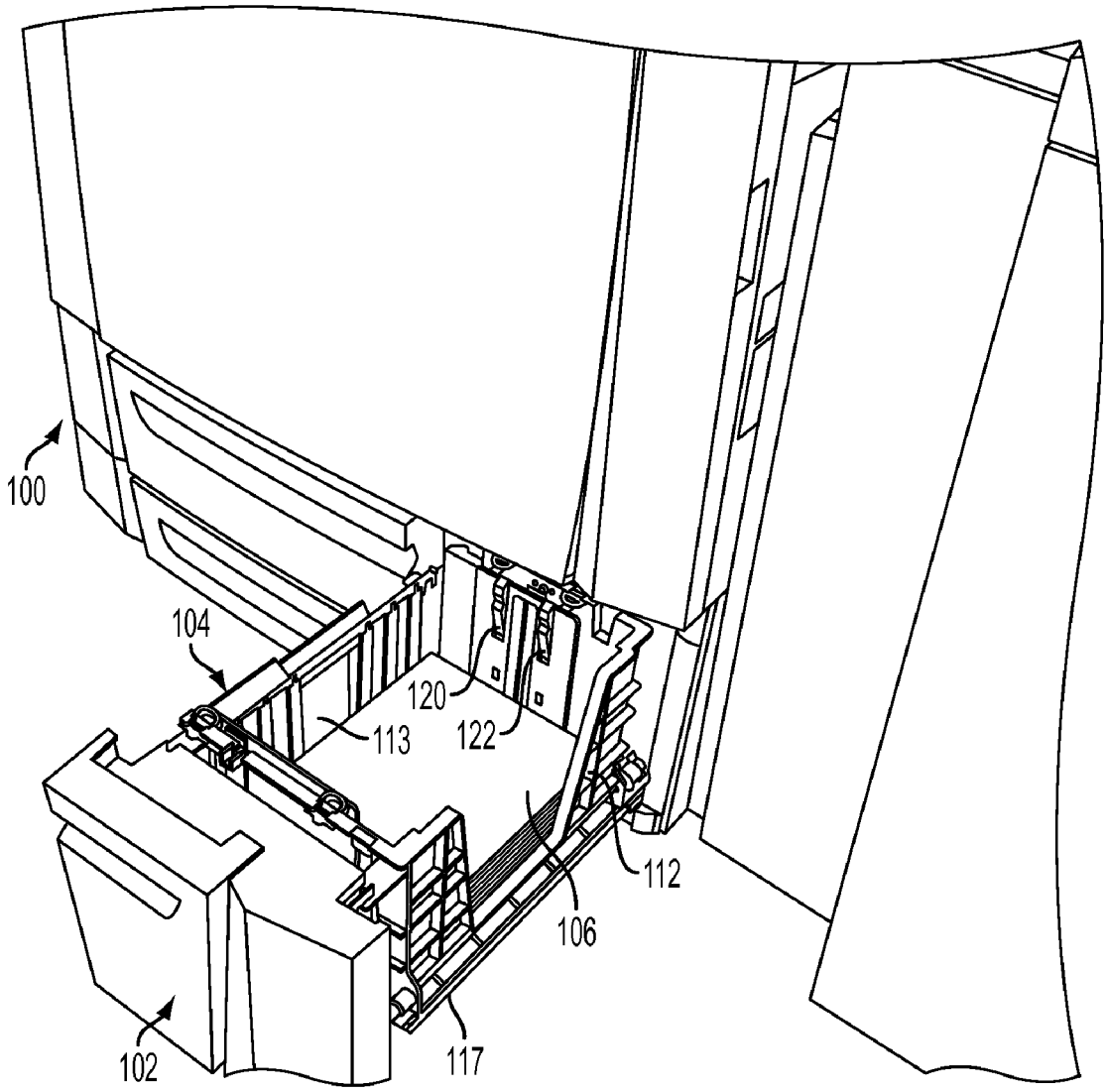
FIG. 2 depicts the printing apparatus of FIG. 1 with a drawer including a media tray.

FIG. 2 shows the drawer 102 of the printing apparatus 100 in an opened position. The drawer 102 includes a media tray 104. A stack of sheets 106 is loaded in the media tray 104. The sheets 106 are fed from the stack to a station in the printing apparatus 100 at which marking material for forming images is applied to the sheets 106.

Embodiments of the media tray 104 can also be included in media feeder modules that can be connected to a printing apparatus. For example, embodiments of the media tray 104 can be used in the feeder modules of the printing apparatus disclosed in U.S. Patent Application No. 2008/0037069, which is incorporated herein by reference in its entirety.

Figure 3:
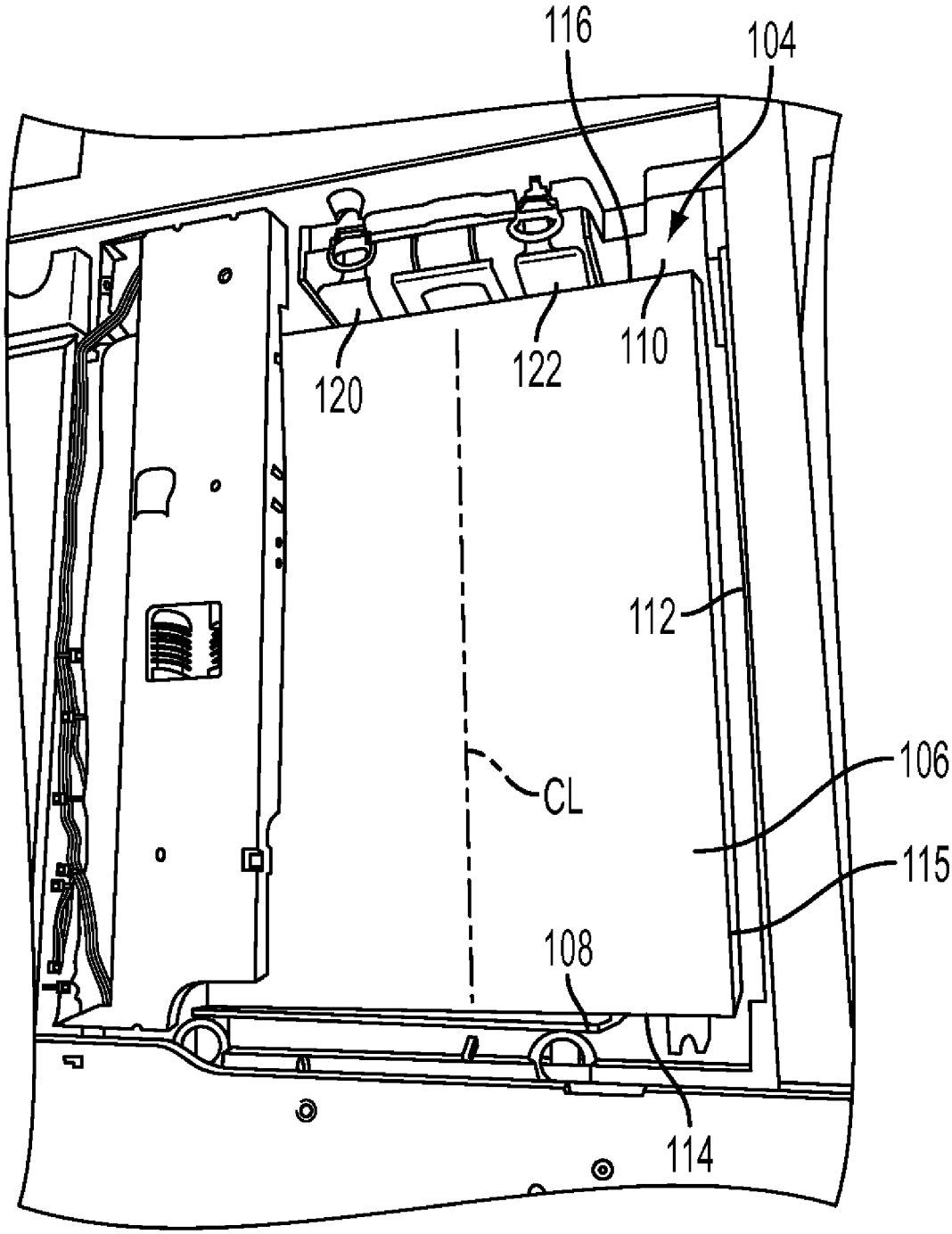
FIG. 3 depicts a stack of sheets loaded in the media tray shown in FIG. 2.

As shown in FIG. 3, the media tray 104 includes a front guide 108, a rear guide 110 opposite the front guide 108, a side wall 112 and an opposite side wall 113 (FIG. 2). The media tray 104 also includes a support surface 117 on which the stack is supported. The front guide 108 is shown in contact with the edge 114 of the stack of sheets 106. The front guide 108 can be, e.g., an outboard (OB) guide media datum for positioning the outboard edge of the sheets 106. The edge 114 of the sheets 106 can be registered evenly across the front guide 108 by urging the edge 114 against the front guide 108. The rear guide 110 can be an inboard (IB) guide for positioning the inboard edge of the sheets 106 in the stack. The location of the paper center line CL extending between the front guide 108 and rear guide 110 is shown. A gap exists between the edge 115 of the sheets 106 and the side wall 112, and between the edge 116 of the sheets 106 and the rear guide 110.

Embodiments of the media trays further include at least two tampers. When sheets are loaded into a media tray by a user, the stack may not be positioned properly for feeding sheets from the stack. The as-loaded stacks can vary in both inboard-to-outboard position and straightness, i.e., alignment with respect to a media loading surface. The as-loaded stack can be slanted, i.e., skewed, with respect to a reference surface. In embodiments, the tampers are constructed to reduce the effects of such variable loading of sheets into the media tray on media feeding. The tampers are constructed to position the sheets in the media tray prior to feeding the sheets from the media tray. The tampers can properly position the stack of sheets against a datum, de-skew the stack, and apply a balanced de-skew force against the sheets as they are fed from the media tray.

Figure 4:
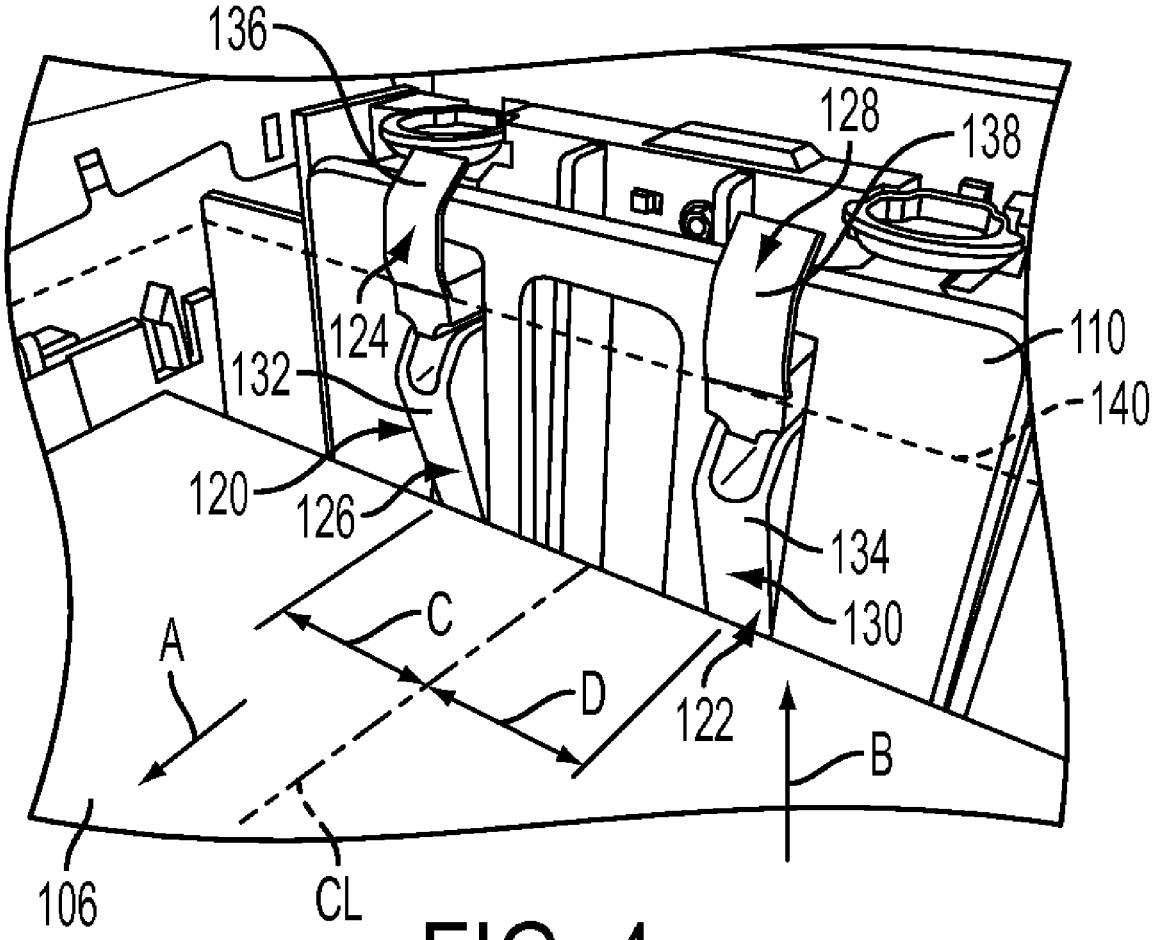
FIG. 4 depicts the media tray shown in FIG. 3 with the stack positioned in a lowered position and an elevated position (broken line).

The embodiment of the media tray 104 shown in FIG. 3 includes two tampers 120, 122 attached to the rear guide 110 at laterally-spaced positions. The rear guide can be, e.g., a flat plate comprised of sheet metal, or the like. As shown, the tampers 120, 122 can be symmetrically positioned with respect to the center line CL of the stack of sheets 106 (or to a reference point on the rear guide 110 aligned with the center line CL) when the sheets 106 are loaded in the media tray 104. The stack is positioned so that the center line CL is centered between the tampers 120, 122 by positioning the stack in contact with the side wall 113. In FIG. 4, the distances C and D of the tampers 120, 122, respectively, from the center line CL along the rear guide 110 can be approximately equal. The tampers 120, 122 can be positioned as close to the center line CL as allowed by constraints of the surrounding structure of the media tray 104. This symmetric positioning of the tampers 120, 122 relative to the stack center line CL can ensure that forces on the sheets 106 of the stack are balanced.

As shown in FIG. 4, the tamper 120 includes an upper pad 124 and a lower pad 126 below the upper pad 124, and the tamper 122 includes an upper pad 128 and a lower pad 130 below the upper pad 128. In embodiments, more than two pads can be provided on each respective tampers 120, 122 when there is sufficient space. Typically, the distance from the bottom ends of the lower pads 126, 130 to about a vertical midpoint of the upper pads 124, 128, respectively, is about 50 mm to about 70 mm, e.g., about 60 mm. The lower pads 126, 130 are constructed to produce a high force to de-skew and control the position of the stack within the media tray 104. The upper pads 124, 128, in contrast, are constructed to separately produce a low force to de-skew and control the position of the top sheets 106 of the stack during feeding. In embodiments, the upper pad 124 and lower pad 126 of the tamper 120 and the upper pad 128 and lower pad 130 of the tamper 122 are vertically aligned with each other.

In embodiments, the pads of the tampers can be comprised of any suitable material that can transmit forces to stacks to position the stacks in the desired position in the media tray. The material can be a rigid material, such as a rigid polymer. In other embodiments, the material can be a softer, deformable polymeric material. In embodiments, the material has a sufficiently-low coefficient of friction to reduce drag forces on sheets during feeding, and sufficient wear resistance to resist cutting by the repeated movement of edges of sheets against the pads.

The tampers are shown in the fully-extended (non-depressed) position in FIGS. 2 and 4. As shown in FIG. 4, the lower pads 126, 130 include respective tapered front surfaces 132, 134. The front surfaces 132, 134 extend outward from the rear guide 110 at an acute angle, e.g., less than about 45 degrees, when fully extended. The front surfaces 132, 134 can be planar. A lifting mechanism (not shown) located within the tray 102 raises the stack. As depicted in FIG. 4, when the stack is raised (as indicated by arrow B), the edges 116 of sheets 106 engage with the front surfaces 132, 134 of the respective lower pads 126, 130. The lower pads 132, 134 are depressed by this engagement with the sheets 106, decreasing the acute angle.

At least one force-producing element (not shown) is provided for each lower pad 126, 130 to move the lower pads 126, 130 outwardly away from the rear guide 110. In embodiments, the force-producing element can be, e.g., at least one spring, such as a compression spring, leaf spring, or the like, which exerts a spring force to resiliently bias the lower pads 126, 130 outwardly away from the rear guide 110. The force-producing elements can be inside of, or behind, the lower pads 126, 130. The lower pads 126, 130 exert a force against the edges 116 of the sheets 106 facing the rear guide 110. Typically, the lower pads 126, 130 can each exert a force of about 4 N to about 8 N, such as about 6 N, to the stack. In embodiments, the lower pads 126, 130 can each apply about the same force to the sheets 106. When the stack is improperly positioned in the media tray 104 during loading, as the stack is elevated, the forces exerted by the lower pads 126, 130 are sufficient to cause the stack to shift forward in the media tray 104 toward the front guide 108, as indicated by arrow A, and reposition the stack relative to the front guide 108.

The upper pads 124, 128 are in the outwardly fully-extended position when the stack of sheets 106 is below the upper pads 124, 128 as shown in FIG. 4. As shown, the upper pads 124, 128 include respective contoured front surfaces 136, 138. As the stack is raised to an elevated position above the lower pads 126, 130, the stack engages with the front surfaces 136, 138 of both upper pads 124, 128, as depicted in broken line 140 in FIG. 4. FIG. 3 also shows the stack of sheets 106 in an elevated position in the media tray 104.

At least one force-producing member (not shown) is provided for each upper pad 124, 128 to move the upper pads 124, 128 outwardly away from the rear guide 110, as shown. In embodiments, the force-producing element can be, e.g., at least one spring, such as a compression spring, leaf spring, or the like, which resiliently biases the upper pads 124, 128 outwardly away from the rear guide 110. The force-producing elements can be inside of, or behind, the upper pads 124, 128. The upper pads 124, 128 exert a force against the edge 116 of the upper sheets 106 of the stack facing the rear guide 110. The tapered profile of the front surfaces 136, 138 creates an even shingling effect. Typically, the upper pads 124, 128 each exert a force of about 0.2 N to about 0.5 N, such as about 0.3 N, to the sheets 106. In embodiments, the upper pads 124, 128 can each apply about the same force to the sheets 106 of the stack.

The forces exerted by the lower pads 126, 130 and the upper pads 124, 128 of the respective tampers 120, 122 act separately and in unison against stacks of sheets. When the stack is loaded improperly in the media tray 104, the forces exerted by the upper pads 124, 128 are sufficient to reposition the upper sheets 106 of the stack relative to the front guide 108. The upper pads 124, 128 control the position of the upper sheets 106 in the media tray 104, and produce a balanced de-skew force during feeding of the sheets 106 from the media tray 104.

Accordingly, the two tampers 120, 122 provide control of the trailing edge of the sheets 106, resulting in less output skew and top edge registration variation. The balanced pair of force-applying tampers 120, 122 allows the sheets 106 to be both positioned and de-skewed at the same time as the stack interacts with the tampers 120, 122.

In embodiments, the tampers 120, 122 can be adjustably movable relative to each other along the rear guide 110 to position the tampers 120, 122 symmetrically with respect to the center line CL of stacks of sheets having significantly different width dimensions. For example, the tampers 120, 122 can be movable along a horizontal slot, or the like, provided at the rear guide 110.

Other embodiments of the media tray can include more than two tampers provided along the rear guide to position stacks of media in a desired manner. For example, embodiments of the media tray can include four tampers spaced from each along the rear guide. With reference to the media tray 104 shown in FIGS. 2 to 4, two inner tampers (e.g., tampers 120, 122) can be laterally spaced from each other along the rear guide 110 and symmetrically positioned relative to the stack center line CL (or to a reference point on the rear guide aligned with the center line), and one outer tamper (not shown) can be positioned between the (inner) tamper 122 and the side wall 112, and another outer tamper (not shown) can be positioned between (inner) tamper 120 and the side wall 113 along the rear guide 110. The outer tampers can also be symmetrically positioned relative to the center line CL of the stack (or to reference point). In embodiments, the (inner) tampers 120, 122, can be positioned approximately equidistant from the center line CL (or to a reference point), and the outer tampers positioned approximately equidistant from the center line CL (or to a reference point), along the rear guide 110.

The outer tampers can have the same construction as the inner tampers. The lower pads of the outer tampers can apply about the same force to stacks of sheets as the lower pads of the inner tampers, and the upper pads of the outer tampers can apply about the same force to stacks of sheets as the upper pads of the inner tampers. In embodiments, the four tampers can position the front edges of the sheets against the front guide, de-skew the stack, and apply a balanced de-skew force against the sheets as the sheets are fed from the media tray.

By incorporating additional tampers, such as four tampers, in the media tray, the force exerted by each lower pad and each upper pad of the tampers against sheets of stacks supported on the media tray can be further reduced as compared to embodiments of the media tray that include two tampers, such as the media tray 104 shown in FIGS. 2 to 4. Each lower pad and upper pad of the four-tamper arrangements can apply a smaller force to sheets of stacks as compared to the lower pads and upper pads of two-tamper arrangements, while still being able to shift the stack and achieve the desired positioning and de-skewing of sheets. For example, the lower pads and upper pads of four-tamper arrangements can be resiliently biased by a spring element having a smaller spring constant than that of spring elements used with the lower pads and upper pads of two-tamper arrangements. In embodiments, the forces exerted by the lower pads and the upper pads of the respective tampers act separately and in unison against stacks of sheets. Lowering the forces exerted against the sheets by the tampers further reduces the possibility of producing any visible effects to the edge of the stack where the respective tampers make contact with the stack.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus for feeding sheets, comprising:
a first guide;
a second guide opposite the first guide;
a first side wall;
a second side wall opposite the first side wall;
a support surface configured to support a stack of sheets with a first edge of the sheets facing the first guide, a second edge of the sheets facing the second guide and a center line of the stack extending from the first edge to the second edge; and
at least two tampers including:
a first tamper secured to the first guide between the center line and the first side wall, the first tamper including a first lower pad and a first upper pad which applies a lower force to the first edge of the sheets than the first lower pad; and
a second tamper secured to the first guide between the center line and the second side wall, the second tamper including a second lower pad and a second upper pad which applies a lower force to the first edge of the sheets than the second lower pad,
wherein the first lower pad and second lower pad each apply about the same force to the first edge of the sheets, and the first upper pad and second upper pad each apply about the same force to the first edge of the sheets, and
wherein the first lower pad and second lower pad each apply a force of about 4 N to about 8 N to the first edge of the sheets, and the first upper pad and second upper pad each apply a force of about 0.2 N to about 0.5 N to the first edge of the sheets.

2. The apparatus of claim 1, wherein:
the first lower pad, first upper pad, second lower pad and second upper pad are each resiliently-biased outwardly from the first guide by at least one force-producing member; and
the first lower pad, first upper pad, second lower pad and second upper pad apply forces to the stack of sheets to position the second edge of the sheets against the second guide, de-skew the stack, and apply a balanced de-skew force against the sheets as the sheets are fed from the media tray.

3. The apparatus of claim 1, wherein the first tamper and second tamper are located approximately equidistant from the center line of the stack of sheets along the first guide when the stack of sheets is supported on the support surface.

4. The apparatus of claim 1, wherein:
the first lower pad includes a first front surface extending outwardly from the first guide at an acute angle;
the second lower pad includes a second front surface extending outwardly from the first guide at an acute angle; and
the first and second front surfaces contact the first edge of the sheets when the stack is elevated in the media tray, which shifts the stack in the direction from the first guide to the second guide and de-skews the stack.

5. A printing apparatus, comprising:
a media tray for feeding sheets, including:
a first guide;
a second guide opposite the first guide;
a first side wall;
a second side wall opposite the first side wall;
the media tray configured to support a stack of sheets with a first edge of the sheets facing the first guide, a second edge of the sheets facing the second guide and a center line of the stack extending from the first edge to the second edge; and
at least two tampers including:
a first tamper secured to the first guide between the center line and the first side wall, the first tamper including a first lower pad and a first upper pad which applies a lower force to the first edge of the sheets than the first lower pad; and
a second tamper secured to the first guide between the center line and the second side wall, the second tamper including a second lower pad and a second upper pad which applies a lower force to the first edge of the sheets than the second lower pad wherein the first lower pad and second lower pad each apply about the same force to the first edge of the sheets, and the first upper pad and second upper pad each apply about the same force to the first edge of the sheets, and wherein the first lower pad and second lower pad each apply a force of about 4 N to about 8 N to the first edge of the sheets, and the first upper pad and second upper pad each apply a force of about 0.2 N to about 0.5 N to the first edge of the sheets.

6. The printing apparatus of claim 5, wherein:

the first lower pad, first upper pad, second lower pad and second upper pad are each resiliently-biased outwardly from the first guide by at least one force-producing member; and the first lower pad, first upper pad, second lower pad and second upper pad apply forces to the stack of sheets to position the second edge of the sheets against the second guide, de-skew the stack, and apply a balanced de-skew force against the sheets as the sheets are fed from the media tray.

7. The printing apparatus of claim 5, wherein the first tamper and second tamper are located approximately equidistant from the center line of the stack of sheets along the first guide when the stack of sheets is supported on the support surface.

8. The printing apparatus of claim 5, wherein:

the first lower pad includes a first front surface extending outwardly from the first guide at an acute angle;

the second lower pad includes a second front surface extending outwardly from the first guide at an acute angle; and the first and second front surfaces contact the first edge of the sheets when the stack is elevated in the media tray, which shifts the stack in the direction from the first guide to the second guide and de-skews the stack.

9. The printing apparatus of claim 5, wherein the media tray is provided on a drawer.

* * * * *